US009125443B2

(12) United States Patent
Ochi et al.

(10) Patent No.: US 9,125,443 B2
(45) Date of Patent: Sep. 8, 2015

(54) RUBBER GLOVE

(75) Inventors: Atsuko Ochi, Kobe (JP); Atsushi Takai, Kobe (JP); Yoshiaki Miyamoto, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 463 days.

(21) Appl. No.: 13/046,315

(22) Filed: Mar. 11, 2011

(65) Prior Publication Data

US 2011/0277214 A1 Nov. 17, 2011

(30) Foreign Application Priority Data

May 17, 2010 (JP) ..... 2010-113388

(51) Int. Cl.
*A41D 19/00* (2006.01)

(52) U.S. Cl.
CPC ..... *A41D 19/0044* (2013.01); *A41D 19/0062* (2013.01); *A41D 19/0055* (2013.01)

(58) Field of Classification Search
CPC ... A41D 13/08; A41D 19/00; A41D 19/0044; A41D 19/0048; A41D 19/0055; A41D 19/0058; A41D 19/0062; A41D 19/0068; A41D 19/0089
USPC ..... 2/16, 20, 59, 162, 168, 170, 161.6, 2/161.7, 158, 159, 160
See application file for complete search history.

(56) References Cited

U.S. PATENT DOCUMENTS

| | | | | | |
|---|---|---|---|---|---|
| 692,703 | A * | 2/1902 | Pfeiffer | 2/168 |
| 924,545 | A * | 6/1909 | Emmert | 2/59 |
| 3,268,647 | A * | 8/1966 | Hayes et al. | 264/303 |
| 3,681,784 | A * | 8/1972 | Lindley | 2/162 |
| 5,734,992 | A * | 4/1998 | Ross | 2/161.7 |
| 5,953,756 | A * | 9/1999 | Vrissimdjis | 2/168 |
| 6,641,879 | B1 * | 11/2003 | Matsuura et al. | 428/35.7 |
| 7,302,711 | B1 * | 12/2007 | Tanenbaum | 2/162 |
| 2004/0092852 | A1 * | 5/2004 | Kruss | 602/21 |
| 2008/0092280 | A1 * | 4/2008 | Johnson et al. | 2/455 |

FOREIGN PATENT DOCUMENTS

| | | | |
|---|---|---|---|
| JP | 38-3179 | A | 2/1988 |
| JP | 2002-105720 | A | 4/2002 |
| JP | 2003-64509 | A | 3/2003 |
| JP | 2003-129315 | A | 5/2003 |
| JP | 2005-171438 | A | 6/2005 |
| JP | 3116303 | U | 12/2005 |
| JP | 2007-119982 | A | 5/2007 |
| JP | 2008-2044 | A | 1/2008 |
| WO | WO 2006/022070 | A1 | 3/2006 |

OTHER PUBLICATIONS

Japanese Office Action with the English translation dated Apr. 19, 2012 for Application No. 2010-113388.

* cited by examiner

*Primary Examiner* — Alissa L Hoey
*Assistant Examiner* — Jameson Collier
(74) *Attorney, Agent, or Firm* — Birch, Stewart, Kolasch & Birch, LLP

(57) ABSTRACT

The rubber glove according to the present invention includes: a sleeve portion generally in the form of a cylinder having a first end and a second end and provided with a cuff formed on the first end; and a glove body linked to the second end of the sleeve portion, wherein the sleeve portion and the glove body are integrally formed by a film of rubber or resin, and the sleeve portion includes a maximum perimeter portion of 240 mm to 360 mm and a drawn portion having a minimum perimeter portion of 50 to 90% of the maximum perimeter portion in length.

9 Claims, 2 Drawing Sheets

RUBBER GLOVE

BACKGROUND OF THE INVENTION

1. Field of the Invention

The present invention relates to a rubber glove integrally formed by a film of rubber or resin.

2. Description of Related Art

The so-called rubber gloves are widely used as work gloves or medical gloves in general households or various industries.

A conventional rubber glove includes a generally cylindrical sleeve portion having a cuff formed on a first end thereof and a glove body linked to a second end of the sleeve portion. The sleeve portion and the glove body are integrally made of natural rubber or synthetic rubber such as acrylonitrile-butadiene rubber (NBR), or resin such as vinyl chloride resin or urethane resin. Those having various thicknesses are known as such rubber gloves.

In recent years, a demand for a soft and flexible rubber glove formed by only a thin film of rubber or resin to be improved in fittedness to the hand of the user or workability in a state worn by the user has tended to increase.

However, the rigidity of the film forming the rubber glove is easily reduced as the film is increased inflexibility and reduced in thickness. Therefore, if the user wears a thin rubber glove while working, for example, the sleeve portion for covering the forearm of the user may easily slip down toward the glove body, or the overall rubber glove may easily slip down or come off the hand of the user. As a result, water disadvantageously penetrates the rubber glove from the cuff when the rubber glove is used for working with water, for example.

In order to solve this problem, each of Patent Document 1 (Japanese Unexamined Patent Publication No. 2007-119982) and Patent Document 2 (Japanese Unexamined Patent Publication No. 2008-2044) proposes a preventer for preventing a rubber glove from slipping down by clipping a cuff of the rubber glove. Further, Patent Document 3 (Japanese Utility Model Registration No. 3116303) proposes a countermeasure for preventing rubber gloves from slipping down by interconnecting cuffs of a pair of rubber gloves with each other by a string member and putting the string member on the neck of the user.

SUMMARY OF THE INVENTION

In the invention disclosed in each of Patent Documents 1 and 2, however, it is troublesome to attach or detach the preventer to or from the rubber glove before or after using the rubber glove.

If one of the pair of rubber gloves is broken, for example, in the invention disclosed in Patent Document 3, the other unbroken rubber glove must disadvantageously be thrown away along with the broken rubber glove.

An object of the present invention is to provide a rubber glove capable of reliably preventing a sleeve portion from slipping down toward a glove body or preventing the overall rubber glove from slipping down or coming off the hand of the user without attaching/detaching a preventer to/from the rubber glove or connecting the rubber glove with another rubber glove by a string member.

In order to solve the aforementioned problem, the rubber glove according to the present invention includes: a sleeve portion generally in the form of a cylinder having a first end and a second end and provided with a cuff formed on the first end; and a glove body linked to the second end of the sleeve portion, wherein the sleeve portion and the glove body are integrally formed by a film of rubber or resin, and the sleeve portion includes a maximum perimeter portion of 240 mm to 360 mm and a drawn portion having a minimum perimeter portion of 50 to 90% of the maximum perimeter portion in length.

According to the present invention, the sleeve portion can be fixed to the forearm of the user with the drawn portion having the minimum perimeter portion when the user pulls on the rubber glove. Therefore, the sleeve portion can be prevented from slipping down toward the glove body or the overall rubber glove can be prevented from slipping down or coming off the hand of the user without attaching a preventer to the rubber glove or connecting the rubber glove with another rubber glove by a string member. Consequently, water can be prevented from penetrating the rubber glove from the cuff when the rubber glove is used for working with water, for example.

Preferably in the rubber glove according to the present invention, the maximum perimeter portion is provided on a side of the drawn portion closer to the glove body, and the drawn portion is formed to gradually decrease in perimeter from the maximum perimeter portion toward the minimum perimeter portion to reach the minimum perimeter portion, and to gradually increase in perimeter from the minimum perimeter portion toward the cuff to reach the cuff. If the maximum perimeter portion is provided on a side of the drawn portion closer to the glove body, the drawn portion may be tapered to decrease in perimeter from the maximum perimeter portion and the cuff toward the minimum perimeter portion respectively. Thus, the user can smoothly pull on and off the rubber glove.

While the thickness of the film forming the rubber glove can be arbitrarily set, the thickness of the film forming the rubber glove according to the present invention is preferably not less than 0.1 mm and not more than 2 mm (0.1 mm to 2 mm). Thus, the sleeve portion can be prevented from slipping down and the overall rubber glove can be prevented from slipping down or coming off the hand of the user due to the function of the drawn portion, and the rubber glove can be improved in fittedness to the hand of the user, workability in a state worn by the user and the like at the same time.

The glove body may include a plurality of finger portions having first ends and second ends with the first ends blocked, and a palm portion collectively linked to the plurality of second ends of the finger portions. In this case, the thickness of the finger portions and the pal portion is also preferably 0.1 mm to 2 mm, similarly to the above.

The sleeve portion may include a wrist portion, shaped according to a human wrist, forming the second end of the sleeve portion. In this case, the maximum perimeter portion is preferably provided between the wrist portion and the drawn portion.

Rubber forming the sleeve portion and the glove body can be prepared from a single type or not less than two types of materials selected from a group consisting of natural rubber, deproteinized natural rubber, acrylonitrile-butadiene rubber, styrene-butadiene rubber and chloroprene rubber.

On the other hand, resin forming the sleeve portion and the glove body can be prepared from a single type or not less than two types of materials selected from a group consisting of vinyl chloride resin, urethane resin and acrylic resin.

Thus, according to the present invention, the sleeve portion can be prevented from slipping down toward the glove body or the overall rubber glove can be prevented from slipping down or coming off the hand of the user without attaching/detaching a preventer to/from the rubber glove or connecting the rubber glove with another rubber glove by a string member. Consequently, a rubber glove hardly penetrated by water can be provided.

The foregoing and other objects, features and effects of the present invention will become more apparent from the following detailed description of the embodiments with reference to the attached drawings.

DETAILED DESCRIPTION OF PREFERRED EMBODIMENTS

Figure 1:
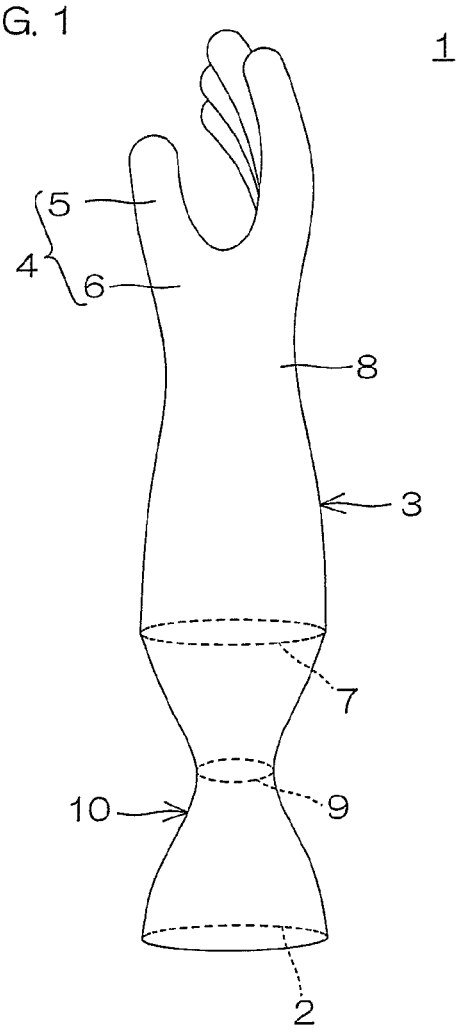
FIG. 1 is a perspective view showing a rubber glove according to an embodiment of the present invention.

FIG. 1 is a perspective view showing a rubber glove according to an embodiment of the present invention.

A rubber glove 1 according to the embodiment includes a sleeve portion 3 generally in the form of a cylinder having a first end and a second end and provided with a cuff 2 formed (opened) on the first end, and a glove body 4 linked to the second end of the sleeve portion 3. The sleeve portion 3 and the glove body 4 are integrally formed by a film of rubber or resin.

The glove body 4 integrally has five (a plurality of) finger portions 5 formed correspondingly to the thumb, the forefinger, the middle finger, the ring finger and the little finger of a human hand to have first and second ends with the first ends blocked, and a palm portion 6 formed correspondingly to the palm (the back) of the human hand and collectively linked to the five second ends of the finger portions 5.

The sleeve portion 3 is formed to vary in perimeter from the side of the glove body 4 toward the side of the cuff 2, and integrally has a maximum perimeter portion 7 having the maximum perimeter of the sleeve portion 3, a wrist portion 8 provided on a side of the maximum perimeter portion 7 closer to the glove body 4 and shaped according to the human wrist, and a drawn portion 10 provided on a side of the maximum perimeter portion 7 closer to the cuff 2 with a minimum perimeter portion 9 having the minimum perimeter of the sleeve portion 3.

In other words, the sleeve portion 3 is formed to gradually increase in perimeter from the wrist portion 8 on the end (the second end of the sleeve portion 3) closer to the glove body 4 toward the cuff 2 to reach the maximum perimeter portion 7, and to reach the cuff 2 from the maximum perimeter portion 7 through the drawn portion 10.

In the rubber glove 1, the drawn portion 10 of the sleeve portion 3 is provided in the vicinity of the cuff 2, while the maximum perimeter portion 7 is provided on the side of the drawn portion 10 closer to the glove body 4.

The drawn portion 10 fits the forearm of the user due to the elasticity of a region in the vicinity of the minimum perimeter portion 9 in the film of rubber or resin forming the rubber glove 1, to prevent the sleeve portion 3 from slipping down toward the glove body 4 or to prevent the overall rubber glove 1 from slipping down or coming off the hand of the user.

In the embodiment shown in FIG. 1, the drawn portion 10 is formed to gradually decrease in perimeter from the maximum perimeter portion 7 to reach the minimum perimeter portion 9 from the side of the glove body 4 toward the cuff 2 through the maximum perimeter portion 7 so that the sleeve portion 3 thereafter gradually increases in perimeter to reach the cuff 2. Thus, the drawn portion 10 is so tapered around the minimum perimeter portion 9 as to guide the hand of the user pulling on or off the rubber glove 1 through the minimum perimeter portion 9, as shown in FIG. 1. Consequently, the user can smoothly pull on or off the rubber glove 1.

In the rubber glove 1, the maximum perimeter $L_{max}$ of the maximum perimeter portion 7 is limited to not less than 240 mm and not more than 360 mm (240 mm to 360 mm), and the perimeter (the minimum perimeter $L_{min}$) of the minimum perimeter portion 9 is limited to not less than 50% and not more than 90% (50 to 90%) of the maximum perimeter $L_{max}$, for the following reasons:

If the minimum perimeter $L_{min}$ is less than 50% of the maximum perimeter $L_{max}$, the thickness of the minimum perimeter portion 9 is so excessively small that the rubber glove 1 is hard to pull on or off, or the user feels pressed on his/her upper arm when wearing the rubber glove 1.

If the minimum perimeter $L_{min}$ exceeds 90% of the maximum perimeter $L_{max}$, on the other hand, the force fitting the region in the vicinity of the minimum perimeter portion 9 on the forearm of the user with the elasticity of the film of rubber or resin forming the rubber glove 1 is reduced. Therefore, no sufficient effect is attained for preventing the sleeve portion 3 from slipping down toward the glove body 4 or for preventing the overall rubber glove 1 from slipping down or coming off the hand of the user.

If the maximum perimeter $L_{max}$ is less than 240 mm, the thickness of the overall sleeve portion 3 is so excessively small that the rubber glove 1 is hard to pull on or off, or the user feels pressed on his/her forearm when wearing the rubber glove 1.

If the maximum perimeter $L_{max}$ exceeds 360 mm, on the other hand, particularly the cuff 2 is so excessively wide that the rubber glove 1 is easily caught by something during working and reduced in workability. Further, it is difficult to attain a sufficient effect of preventing the sleeve portion 3 from slipping down toward the glove body 4 or for preventing the overall rubber glove 1 from slipping down or coming off the hand of the user.

While the thickness of the film forming the rubber glove 1 can be arbitrarily set, the thickness is preferably not less than 0.1 mm, particularly preferably not less than 0.2 mm, and preferably not more than 2 mm, particularly not more than 1.5 mm on the finger portions 5, the palm portion 6 and the sleeve portion 3 in particular.

If the thickness of the rubber glove 1 is less than 0.1 mm, the force fitting the region in the vicinity of the minimum perimeter portion 9 on the forearm of the user with the elasticity of the film of rubber or resin forming the rubber glove 1 is reduced. Consequently, the sleeve portion 3 may easily slip down toward the glove body 4, or the overall rubber glove 1 may easily slip down or come off the hand of the user.

If the thickness of the rubber glove 1 exceeds 2 mm, on the other hand, the fittedness to the hand of the user or the workability in the state where the user wears the rubber glove 1 may be reduced.

The thickness of the rubber glove 1 may not be entirely in the aforementioned range, but the cuff 2 may have a greater thickness than the remaining portions to have proper rigidity, for example. Thus, the user can more easily pull on or off the rubber glove 1. Alternatively, the forward ends of the finger portions 7 may have a greater thickness than the remaining portions. Thus, impacts applied to the tips of the thumb and the fingers of the user can be reduced, thereby protecting the tips.

The rubber glove 1 having the aforementioned structure can be manufactured by a method of shaping rubber latex into the rubber glove 1 by dipping and vulcanizing the rubber or a method of shaping resin emulsion into the rubber glove 1 by dipping and drying/hardening the resin, for example.

In order to prepare the rubber glove 1 from rubber, for example, a mold corresponding to the shape of the rubber glove 1 shown in FIG. 1 is prepared, and the surface of the mold is treated with a coagulator of calcium nitrate or the like.

Then, an unvulcanized or pre-vulcanized immersion liquid is prepared by adding additives such as a vulcanizing agent, a vulcanization accelerator, a supplement vulcanization accelerator (an activator), an age resistor, a filler, a dispersing agent and the like to rubber latex.

Then, the mold is dipped in the immersion liquid over a constant time and thereafter pulled up, thereby sticking the immersion liquid to the surface of the mold.

Then, the rubber glove 1 shown in FIG. 1 is manufactured by drying the immersion liquid and vulcanizing the rubber by heating the immersion liquid along with the mold, or by temporarily drying the immersion liquid, thereafter vulcanizing the rubber by heating the immersion liquid along with the mold and thereafter demolding the same.

Any latexifiable rubber selected from natural rubber and synthetic rubber can be used for manufacturing the rubber glove 1. Such rubber can be prepared from a single type or not less than two types of natural rubber, deproteinized natural rubber, acrylonitrile-butadiene rubber (NBR), styrene-butadiene rubber (SBR), chloroprene rubber (CR) and the like, for example.

The vulcanizing agent can be prepared from sulfur, an organic sulfur-containing compound and the like, for example. The content of the vulcanizing agent is preferably not less than about 0.5 parts by mass and not more than about 3 parts by mass with respect to 100 parts by mass of the solid content (the rubber content) in the rubber latex, for example.

The vulcanization accelerator can be prepared from a single type or not less than two types of PX (zinc N-ethyl-N-phenyldithiocarbamate), PZ (zinc dimethyldithiocarbamate), EZ (zinc diethyldithiocarbamate), BZ (zinc dibutyldithiocarbamate), MZ (zinc salt of 2-mercaptobenzothiazole), Tt (tetramethylthiuram disulfide) and the like, for example.

The content of the vulcanization accelerator is preferably not less than about 0.5 parts by mass and not more than about 3 parts by mass with respect to 100 parts by mass of the rubber content in the rubber latex, for example.

The supplement vulcanization accelerator can be prepared from one or two types of zinc white (zinc oxide), stearic acid and the like, for example. The content of the supplement vulcanization accelerator is preferably not less than about 0.5 parts by mass and not more than about 3 parts by mass with respect to 100 parts by mass of the rubber content in the rubber latex, for example.

The age resistor, preferably prepared from anti-staining phenol in general, may also be prepared from amine. The content of the age resistor is preferably not less than about 0.5 parts by mass and not more than about 3 parts by mass with respect to 100 parts by mass of the rubber content in the rubber latex, for example.

The filler can be prepared from a single type or not less than two types of kaolin clay, hard clay, calcium carbonate and the like, for example. The content of the filler is preferably not less than about 10 parts by mass with respect to 100 parts by mass of the rubber content in the rubber latex, for example.

The dispersing agent is added for excellently dispersing the aforementioned additives into the rubber latex. The dispersing agent can be prepared from a single type or not less than two types of anionic surface-active agents, for example. The content of the dispersing agent is preferably not less than about 0.3 parts by mass and not more than about 1 part by mass of the sum of the components to be dispersed into the rubber latex, for example.

In order to prepare the rubber glove 1 from resin, on the other hand, a mold corresponding to the shape of the rubber glove 1 shown in FIG. 1 is prepared, and the surface of the mold is treated with a coagulator of calcium nitrate or the like.

Further, an immersion liquid is prepared by adding various additives such as an age resistor, a filler, a dispersing agent and the like to resin emulsion.

Then, the mold is dipped in the immersion liquid over a constant time and thereafter pulled up, thereby sticking the immersion liquid to the surface of the mold.

Then, the rubber glove 1 shown in FIG. 1 is manufactured by temporarily drying the immersion liquid and thereafter hardening the resin by heating the immersion liquid along with the mold if necessary, or by drying the immersion liquid and hardening the resin by heating the immersion liquid along with the mold and thereafter demolding the same.

The resin can be prepared from a single type or not less than two types of emulsifiable resin such as vinyl chloride resin, urethane resin, acrylic resin and the like, for example.

The age resistor can be prepared from a single type or not less than two types of the aforementioned anti-staining phenol, amine and the like. The content of the age resistor is preferably not less than about 0.5 parts by mass and not more than about 3 parts by mass with respect to 100 parts by mass of the solid content (the resin content) in the resin emulsion, for example.

The filler can be prepared from a single type or not less than two types of the aforementioned fillers, for example. The content of the filler is preferably not less than about 10 parts by mass with respect to 100 parts by mass of the resin content in the resin emulsion, for example.

The dispersing agent can be prepared from a single type or not less than two types of the aforementioned anionic surface-active agents, for example. The content of the dispersing agent is preferably not less than about 0.3 parts by mass and not more than about 1 part by mass of the sum of the components to be dispersed into the resin emulsion, for example.

The rubber glove 1, basically preferably formed to have a single-layer structure with only a thin film of rubber or resin, may also be reinforced with fiber or the like, if necessary. In other words, the so-called support-type rubber glove may be manufactured by integrating a knitted glove of fiber and a film of rubber or resin with each other.

The support-type rubber glove can be manufactured by forming the film of rubber or resin by the aforementioned dipping and integrating the same with the knitted glove previously mounted on the surface of a mold.

The knitted glove can be formed by a seamless knitted glove, a jersey knitted glove or the like knitted from fiber of cotton, nylon, polyester or the like, for example.

EXAMPLES

While the present invention is now described with reference to Examples and comparative examples, the present invention is not restricted to the following Examples.

Example 1

(1) Preparation of Immersion Liquid

An immersion liquid was prepared by adding 1 part by mass of sulfur (a vulcanizing agent), 1 part by mass of a vulcanization accelerator BZ (zinc dibutyldithiocarbamate), 1 part by mass of zinc white (a supplement vulcanization accelerator) and a proper amount of an age resistor (a butylated product of p-cresol and dichloropentadiene) to natural rubber latex with respect to 100 parts by mass of the rubber content in the natural rubber latex and thereafter pre-vulcanizing the natural rubber latex at 30° C. for 24 to 48 hours.

(2) Manufacturing of Rubber Globe

An earthenware mold corresponding to the shape of the rubber glove 1 shown in FIG. 1 was prepared by setting the dimensions of the respective portions thereof so that the maximum perimeter $L_{max}$ of a maximum perimeter portion 7 of the manufactured rubber glove 1 was 240 mm and the minimum perimeter $L_{min}$ of a minimum perimeter portion 9 of a drawn portion 10 was 50% of the maximum perimeter $L_{max}$.

Then, the mold was dipped in aqueous calcium nitrate, pulled up and thereafter dried, thereby treating the surface of the mold with calcium nitrate serving as a coagulator.

Then, the mold treated with calcium nitrate was dipped in the aforementioned immersion liquid kept at a temperature of 25° C. at a constant speed, held for 30 seconds and thereafter pulled up at a constant speed, thereby sticking the immersion liquid to the surface of the mold.

Then, the immersion liquid was introduced into an oven heated to 100° C. along with the mold and heated for 60 minutes, thereby drying the immersion liquid and vulcanizing the rubber, and the immersion liquid was thereafter demolded, to manufacture a rubber glove 1 having a single-layer structure formed by only a film of natural rubber in the cubic shape shown in FIG. 1.

The average thickness of a sleeve portion 3, including the drawn portion 10, of the rubber glove 1 measured with a micrometer was 0.45 mm.

Example 2

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 240 mm and the minimum perimeter $L_{min}$ of a minimum perimeter portion 9 of a drawn portion 10 was 90% of the maximum perimeter $L_{max}$.

The average thickness of a sleeve portion 3, including the drawn portion 10, of the rubber glove 1 measured with a micrometer was 0.45 mm.

Comparative Example 1

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 240 mm and the minimum perimeter $L_{min}$ of a minimum perimeter portion 9 of a drawn portion 10 was 40% of the maximum perimeter $L_{max}$.

The average thickness of a sleeve portion 3, including the drawn portion 10, of the rubber glove 1 measured with a micrometer was 0.45 mm.

Comparative Example 2

Figure 2:
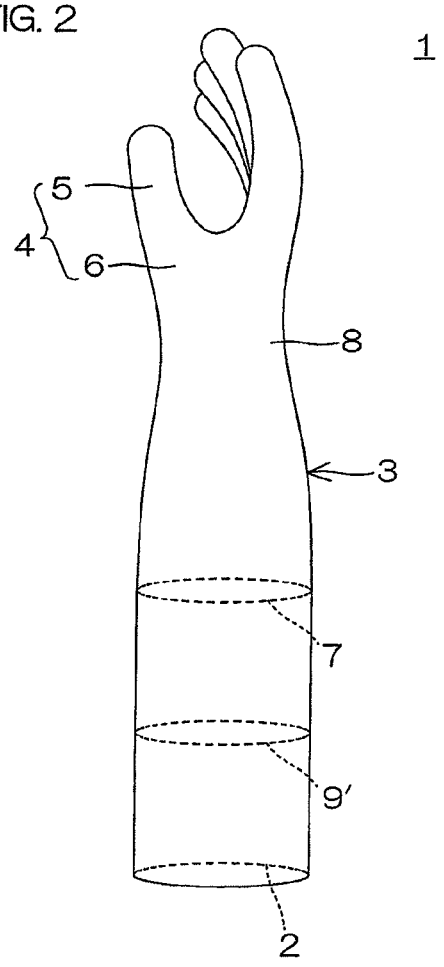
Prior Art FIG. 2
FIG. 2 is a perspective view showing an example of a conventional rubber glove.

A conventional rubber glove 1 was manufactured with a sleeve portion 3 including no drawn portion 10 and having a uniform perimeter from a maximum perimeter portion 7 to a cuff 2, as shown in FIG. 2. In other words, the rubber glove 1 having a single-layer structure formed by only a film of natural rubber in the cubic shape shown in FIG. 2 was manufactured similarly to Example 1, except that a mold was prepared by setting the dimensions of the respective portions thereof so that the maximum perimeter $L_{max}$ of the maximum perimeter portion 7 of the manufactured rubber glove 1 was 240 mm and the perimeter on a position 9' corresponding to a minimum perimeter portion was 100% of the maximum perimeter $L_{max}$.

The average thickness of the sleeve portion 3 of the rubber glove 1 measured with a micrometer was 0.45 mm.

Examples 3 and 4

Comparative Example 3

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 360 mm and the minimum perimeter $L_{max}$ of a minimum perimeter portion 9 of a drawn portion 10 was 40% (comparative example 3), 50% (Example 3) or 90% (Example 4) of the maximum perimeter $L_{max}$.

The average thickness of a sleeve portion 3, including the drawn portion 10, of the rubber glove 1 measured with a micrometer was 0.45 mm.

Comparative Example 4

A rubber glove 1 having a single-layer structure formed by only a film of natural rubber in the cubic shape shown in FIG. 2 was manufactured similarly to comparative example 2, except that a mold was prepared by setting the dimensions of the respective portions thereof so that the maximum perimeter $L_{max}$ of a maximum perimeter portion 7 of the manufactured rubber glove 1 was 360 mm and the perimeter on a position 9' corresponding to a minimum perimeter portion was 100% of the maximum perimeter $L_{max}$.

The average thickness of a sleeve portion 3 of the rubber glove 1 measured with a micrometer was 0.45 mm.

Comparative Examples 5 and 6

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 230 mm and the minimum perimeter $L_{min}$ of a minimum perimeter portion 9 of a drawn portion 10 was 50% (comparative example 5) or 90% (comparative example 6) of the maximum perimeter $L_{max}$.

The average thickness of a sleeve portion 3, including the drawn portion 10, of the rubber glove 1 measured with a micrometer was 0.45 mm.

Comparative Examples 7 and 8

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 370 mm and the minimum perimeter $L_{min}$ of a minimum perimeter portion 9 of a drawn portion 10 was 50% (comparative example 7) or 90% (comparative example 8) of the maximum perimeter $L_{max}$.

The average thickness of a sleeve portion 3, including the drawn portion 10, of the rubber glove 1 measured with a micrometer was 0.45 mm.

Example 5

A rubber glove 1 having a single-layer structure formed by only a film of natural rubber in the cubic shape shown in FIG. 1 was manufactured similarly to Example 1, except that a mold was prepared by setting the dimensions of the respective portions thereof so that the maximum perimeter $L_{max}$ of a maximum perimeter portion 7 of the manufactured rubber glove 1 was 300 mm and the minimum perimeter $L_{min}$ of a minimum perimeter portion 9 of a drawn portion 10 was 70% of the maximum perimeter $L_{max}$.

The average thickness of a sleeve portion 3, including the drawn portion 10, of the rubber glove 1 measured with a micrometer was 0.45 mm.

Example 6

A rubber glove 1 having a single-layer structure formed by only a film of NBR in the cubic shape shown in FIG. 1 was manufactured similarly to Example 5, except that an immersion liquid wad prepared by adding 1 part by mass of sulfur (a vulcanizing agent), 1 part by mass of a vulcanization accelerator BZ (zinc dibutyldithiocarbamate), 1 part by mass of zinc white (a supplement vulcanization accelerator) and a proper amount of an age resistor (a butylated product of p-cresol and dichloropentadiene) to NBR latex with respect to 100 parts by mass of the rubber content in the NBR latex.

The average thickness of a sleeve portion 3, including a drawn portion 10, of the rubber glove 1 measured with a micrometer was 0.45 mm.

Example 7

A rubber glove 1 having a single-layer structure formed by only a film of CR in the cubic shape shown in FIG. 1 was manufactured similarly to Example 5, except that an immersion liquid wad prepared by adding 1 part by mass of sulfur (a vulcanizing agent), 1 part by mass of a vulcanization accelerator BZ (zinc dibutyldithiocarbamate), 1 part by mass of zinc white (a supplement vulcanization accelerator) and a proper amount of an age resistor (a butylated product of p-cresol and dichloropentadiene) to CR latex with respect to 100 parts by mass of the rubber content in the CR latex.

The average thickness of a sleeve portion 3, including a drawn portion 10, of the rubber glove 1 measured with a micrometer was 0.45 mm.

Example 8

A support-type rubber glove 1 formed by a jersey knitted glove and a film of natural rubber integrated with each other and having the cubic shape shown in FIG. 1 was manufactured similarly to Example 5, except that the jersey knitted glove was previously mounted on a mold.

The average thickness of a sleeve portion 3, including a drawn portion 10, of the rubber glove 1 measured with a micrometer was 1 mm.

<Evaluation Test>

(1) Evaluation of Slip Preventing Effect

A subject wore the rubber glove manufactured according to each of the aforementioned Examples and comparative examples, and raised and lowered his/her arm 10 times, to measure a distance by which the cuff slipped toward the glove body as compared with the state immediately after the subject pulled on the rubber glove. The slip preventing effect of the rubber glove was evaluated under the following criteria:

X: Not less than 5 cm. Defective in slip preventing effect.

Δ: Not less than 3 cm and less than 5 cm. Slightly defective in slip preventing effect.

○: Not less than 1 cm and less than 3 cm. Excellent in slip preventing effect.

◎: Less than 1 cm. Extremely excellent in slip preventing effect.

(2) Presence or Absence of Pressure

The subject wore the rubber glove manufactured according to each of the aforementioned Examples and comparative examples, and evaluated whether or not he/she felt pressed on the upper arm after 10 minutes under the following criteria:

X: Pressed.

Δ: Slightly pressed.

○: Hardly pressed.

◎: Not at all pressed.

(3) Evaluation of Easiness to Pull On/Off

The subject repeatedly pulled on and off the rubber glove manufactured according to each of the aforementioned Examples and comparative examples 10 times, to measure the time required therefor. Easiness to pull on/off the rubber glove was evaluated under the following criteria:

X: Not less than 40 seconds. Defective in easiness to pull on/off.

Δ: Not less than 30 seconds and less than 40 seconds. Slightly defective in easiness to pull on/off.

○: Not less than 20 seconds and less than 30 seconds. Excellent in easiness to pull on/off.

◎: Less than 20 seconds. Extremely excellent in easiness to pull on/off.

(4) Evaluation of Workability

The subject wore the rubber glove manufactured according to each of the aforementioned Examples and comparative examples, and moved an object from side to side on a desk on which obstacles were placed, to evaluate workability of the rubber glove under the following criteria:

X: Object was extremely hard to move. Defective in workability.

Δ: Object was hard to move. Slightly defective in workability.

○: Object was easy to move. Excellent in workability.

◎: Object was extremely easy to move. Extremely excellent in workability.

Tables 1 shows the results of the aforementioned evaluations (1) to (4). Referring to Table 1, numerals in the column of the subject are as follows. As to the parenthesized remarks, refer to "Japanese body size data 1992-1994" by Research Institute of Human Engineering for Quality Life.

(1) Maximum perimeter of forearm: 180 mm (approximation to the minimum of adult woman)

(2) Maximum perimeter of forearm: 235 mm (approximation to the average of adult men and women)

(3) Maximum perimeter of forearm: 314 mm (approximation to the maximum of adult men)

TABLE 1

| | Rubber Globe | | | | | Evaluation | | | | |
|---|---|---|---|---|---|---|---|---|---|---|
| | Maximum Perimeter (mm) | Perimeter Ratio (%) | Drawn Portion | Rubber | Structure | Slip Preventing Effect | Pressure | Easiness to Pull On/Off | Workability | Subject |
| Example 1 | 240 | 50 | Provided | Natural Rubber | Single Layer | ◎ | ○ | ◎ | ◎ | (1) |
| Example 2 | 240 | 90 | Provided | Natural Rubber | Single Layer | ○ | ◎ | ○ | ◎ | (2) |
| Example 3 | 360 | 50 | Provided | Natural Rubber | Single Layer | ◎ | ○ | ◎ | ○ | (2) |
| Example 4 | 360 | 90 | Provided | Natural Rubber | Single Layer | ○ | ◎ | ◎ | ◎ | (3) |
| Example 5 | 300 | 70 | Provided | Natural Rubber | Single Layer | ◎ | ◎ | ◎ | ◎ | (2) |
| Example 6 | 300 | 70 | Provided | NBR | Single Layer | ◎ | ◎ | ◎ | ◎ | (2) |
| Example 7 | 300 | 70 | Provided | CR | Single Layer | ◎ | ◎ | ◎ | ◎ | (2) |
| Example 8 | 300 | 70 | Provided | Natural Rubber | Composite | ◎ | ◎ | ◎ | ◎ | (2) |
| Comparative Example 1 | 240 | 40 | Provided | Natural Rubber | Single Layer | ◎ | X | X | ◎ | (1) |
| Comparative Example 2 | 240 | 100 | Not Provided | Natural Rubber | Single Layer | Δ | ◎ | ○ | ◎ | (2) |
| Comparative Example 3 | 360 | 40 | Provided | Natural Rubber | Single Layer | ◎ | X | ◎ | ○ | (2) |
| Comparative Example 4 | 360 | 100 | Not Provided | Natural Rubber | Single Layer | X | ◎ | Δ | ◎ | (3) |
| Comparative Example 5 | 230 | 50 | Provided | Natural Rubber | Single Layer | ◎ | Δ | ◎ | ◎ | (1) |
| Comparative Example 6 | 230 | 90 | Provided | Natural Rubber | Single Layer | ◎ | ◎ | X | ◎ | (2) |
| Comparative Example 7 | 370 | 50 | Provided | Natural Rubber | Single Layer | ◎ | ○ | ◎ | X | (2) |
| Comparative Example 8 | 370 | 90 | Provided | Natural Rubber | Single Layer | Δ | ◎ | ◎ | ◎ | (3) |

It has been realized from the results of comparative examples 1 to 4 shown in Table 1 that the easiness to pull on/off the rubber glove is reduced or the user feels pressed on the upper arm if the minimum perimeter $L_{min}$ is less than 50% of the maximum perimeter $L_{max}$ when the maximum perimeter of the sleeve portion is in the range of not less than 240 mm and not more than 360 mm. It has also been recognized that no effect of preventing the rubber glove from slipping down can be attained if the minimum perimeter $L_{min}$ exceeds 90% of the maximum perimeter $L_{max}$.

It has been realized from the results of comparative examples 5 to 8 that the easiness to pull on/off the rubber glove is reduced or the user feels pressed on the upper arm if the maximum perimeter of the sleeve portion is less than 240 mm when the minimum perimeter $L_{min}$ is in the range of not less than 50% and not more than 90% of the maximum perimeter $L_{max}$. It has also been recognized that the workability is reduced or no effect of preventing the rubber glove from slipping down can be attained if the maximum perimeter of the sleeve portion exceeds 360 mm.

On the other hand, it has been confirmed from the results of Examples 1 to 8 that the rubber glove maintains excellent easiness to pull on/off and excellent workability and can attain an excellent slip preventing effect while the user does not feel pressed on the upper arm if the maximum perimeter of the sleeve portion is in the range of not less than 240 mm and not more than 360 mm and the minimum perimeter $L_{min}$ is in the range of not less than 50% and not more than 90% of the maximum perimeter $L_{max}$.

Further, it has been confirmed from the results of Examples 5 to 8 that the rubber forming the rubber glove is not restricted to natural rubber, but similar effects can be attained with various types of rubber. It has also been confirmed that the structure of the rubber glove is not restricted to the single-layer structure formed by only the film of rubber, but a support-type rubber glove can also attain similar effects.

While the present invention has been described in detail by way of the embodiments thereof, it should be understood that these embodiments are merely illustrative of the technical principles of the present invention but not limitative of the invention. The spirit and scope of the present invention are to be limited only by the appended claims.

This application corresponds to Japanese Patent Application No. 2010-113388 filed with the Japan Patent Office on May 17, 2010, the disclosure of which is incorporated herein by reference.

What is claimed is:

1. A rubber glove comprising:

a sleeve portion generally in the form of a cylinder having a first end and a second end and provided with a cuff formed on the first end; and a glove body linked to the second end of the sleeve portion, wherein the sleeve portion and the glove body are integrally formed by a film of rubber or resin, and the sleeve portion includes a maximum perimeter portion of 240 mm to 360 mm and a drawn portion having a minimum perimeter portion of 50 to 90% of the maximum perimeter portion in circumferential length measured along a surface of the sleeve portion, wherein the maximum perimeter portion is provided on a side of the drawn portion closer to the glove body, the drawn portion has two truncated cone bodies which have a common top portion at the minimum perimeter portion such that the perimeter of the drawn portion gradually decreases from the maximum perimeter portion toward the minimum perimeter portion and gradually increases from the minimum perimeter portion toward the cuff, and to fit the arm of the user based on the elasticity of a region in the vicinity of the minimum perimeter portion so as to substantially prevent the sleeve portion from slipping towards the glove body.

2. The rubber glove according to claim 1, wherein the drawn portion is tapered to decrease in perimeter from the maximum perimeter portion toward the minimum perimeter portion and to decrease in perimeter from the cuff toward the minimum perimeter portion.

3. The rubber glove according to claim 1, wherein the thickness of the film is 0.1 mm to 2 mm.

4. The rubber glove according to claim 1, wherein the glove body includes a plurality of finger portions having first ends and second ends with the first ends closed, and a palm portion collectively linked to the plurality of second ends of the finger portions.

5. The rubber glove according to claim 4, wherein the sleeve portion includes a wrist portion, shaped according to a human wrist, forming the second end of the sleeve portion.

6. The rubber glove according to claim 5, wherein the maximum perimeter portion is provided between the wrist portion and the drawn portion.

7. The rubber glove according to claim 1, wherein the sleeve portion and the glove body are made of a single type or not less than two types of materials selected from a group consisting of natural rubber, deproteinized natural rubber, acrylonitrile-butadiene rubber, styrene-butadiene rubber and chloroprene rubber.

8. The rubber glove according to claim 1, wherein the sleeve portion and the glove body are made of a single type or not less than two types of materials selected from a group consisting of vinyl chloride resin, urethane resin and acrylic resin.

9. The rubber glove according to claim 1, wherein the glove is prevented from slipping without attaching/detaching a preventer to/from the rubber glove.

* * * * *